United States Patent [19]

Felthuis et al.

[11] Patent Number: 4,881,895

[45] Date of Patent: Nov. 21, 1989

[54] CERAMIC GAS BURNER FOR A COMBUSTION CHAMBER OF A HOT-BLAST STOVE

[75] Inventors: Jacob Felthuis, Alkmaar; Ronald J. M. Stokman, Hillegom, both of Netherlands

[73] Assignee: Hoogovens Groep B.V., Ijmuiden, Netherlands

[21] Appl. No.: 232,670

[22] Filed: Aug. 16, 1988

[30] Foreign Application Priority Data

Aug. 31, 1987 [NL] Netherlands ..... 8702036

[51] Int. Cl.[4] ..... F24H 1/00

[52] U.S. Cl. ..... 432/181; 432/217; 432/222; 431/158; 431/190

[58] Field of Search ..... 432/181, 30, 40, 217, 432/222; 431/158, 190

[56] References Cited

U.S. PATENT DOCUMENTS

| | | | |
|---|---|---|---|
| 2,583,736 | 1/1952 | Hess | 431/158 |
| 3,568,932 | 3/1971 | Van Laar | 431/190 |
| 3,627,284 | 12/1971 | Van Laar | 432/217 |
| 3,887,134 | 6/1975 | Hacker | 432/217 |
| 3,891,384 | 6/1975 | Hovis et al. | 432/217 |
| 4,259,064 | 3/1981 | Laux et al. | 432/217 |
| 4,353,688 | 10/1982 | Ahner et al. | 432/217 |

FOREIGN PATENT DOCUMENTS 0090096 10/1983 European Pat. Off. .

*Primary Examiner*—Henry C. Yuen

*Attorney, Agent, or Firm*—Stevens, Davis, Miller & Mosher

[57] ABSTRACT

A ceramic gas burner for a combustion chamber of a hot-blast stove of a blast furnace has parallel vertical supply ducts for the two combustion components (gas and air). One duct opens upwardly at a first outlet opening which is rectangular in shape. The second duct opens at second outlet openings which are on each side of and above the first outlet opening and whose outflow directions are oblique to that of the first outlet opening. Recesses extend in each long side of the first opening towards the second openings. To improve the mixing of the two components, opposite each recess there is another such recess in the other long side of the opening.

4 Claims, 1 Drawing Sheet

CERAMIC GAS BURNER FOR A COMBUSTION CHAMBER OF A HOT-BLAST STOVE

BACKGROUND OF THE INVENTION

1. FIELD OF THE INVENTION

The invention relates to a ceramic gas burner for a combustion chamber of a hot-blast stove, e.g. a hot-blast stove of a blast furnace.

2. DESCRIPTION OF THE PRIOR ART

A burner of this type is described in EP-A-90096 which has parallel vertical supply ducts for the two combustion components (gas and air). A first one of these ducts opens upwardly at a first outlet opening which in plan view is essentially rectangular in shape, while the second duct opens at second outlet openings which are on each side of and above the first outlet opening. The outflow directions of the second outlet openings are oblique to that of the first outlet opening.

In the long sides of its first outlet opening this burner has a plurality of recesses extending outwardly towards the second outlet openings. These recesses are provided for alternate second outlet openings on each long side of the first outlet opening. The recesses on the two long sides of the first outlet openings are staggered, so that no recess on one long side is opposite a recess on the other long side.

In burners for hot-blast stoves it is important that no combustible components from the combustion gas remain unburnt, or that scarcely any such combustible components remain unburnt. On the other hand it is desirable to reduce the excess of air required for combustion in order to achieve as high as possible a flame temperature at a specific calorific value of the combustion gas. It is known that improving the mixing of gas and air helps to achieve these objectives.

The object of the invention is to improve the mixing of the gaseous components in the burner of EP-A-0090096. Other advantages may be achieved, which will be explained in the following.

The ceramic burner in accordance with the invention is characterised in that, with respect to each recess in a first one of the long sides of the first outlet opening, there is correspondingly one recess directly opposite in the second long side of the first outlet opening.

It is preferable that for each of the second outlet openings of the burner, there is correspondingly one of the recesses.

This particularly simply shaped burner achieves a very intensive mixture at many places along the long sides of the first outlet opening, which, by lowering the point where the turbulence generated is complete, leads to a more stable flame and lower quantities of unburnt combustible component remaining.

A particular advantage is obtained with the burner in accordance with the invention, if it is constructed from a pack of shaped bricks. Through the greater regularity of the shape of the burner in accordance with the invention, it has been found possible to achieve considerable savings, e.g. of up to 80%, in the number of different shaped bricks used.

It is advantageous if the recesses, as seen in the outflow direction, have outwardly widening cross sections. Preferably this widening is in the direction perpendicular to the long sides of the first outlet opening.

BRIEF INTRODUCTION OF THE DRAWING

The invention will be now illustrated by way of non-limitative example with reference to the accompanying drawing which shows an embodiment and in which:

FIG. 1 shows the head of a ceramic burner embodying the invention in plan view; and FIG. 2 shows a cross-section on the line II—II in FIG. 1.

DESCRIPTION OF THE PREFERRED EMBODIMENT

The location and operation of the burner in the combustion chamber of a hot-blast stove for a blast furnace is well known and does not need to be explained in detail here. Reference is made for example to EP-A-90096.

Figure 1:
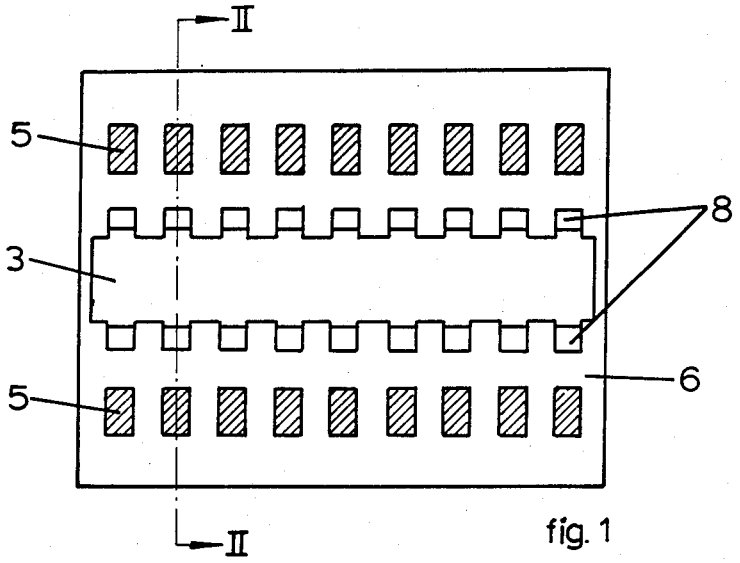
Figure 2:
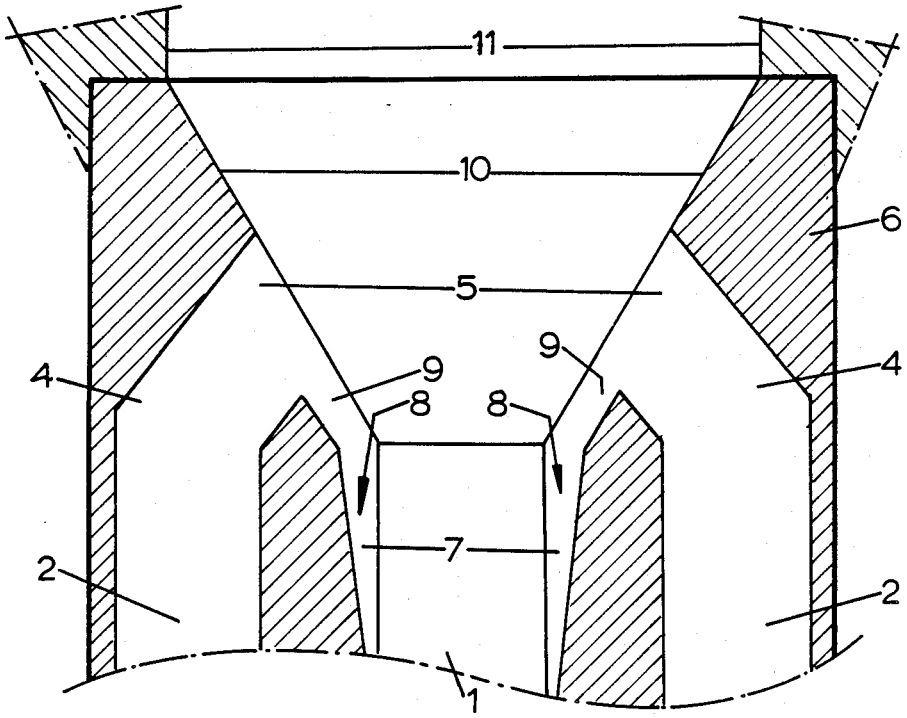

Referring to FIGS. 1 and 2, combustion gas is fed through a central supply duct 1 in the burner head 6, the gas flowing out into a combustion shaft of the hot-blast stove at the outlet opening 3. In plan view, the outlet opening 3 has a rectangular slot shape, with two long sides. Two boundary surfaces 10 (see FIG. 2) of the burner head extend outwardly and upwardly at ana ngle from the outlet opening 3 to join the walls 11 of the combustion chamber which are partly shown in FIG. 2 but not in FIG. 1.

On both sides of supply duct 1 there are two air supply ducts 2, parallel to the central duct 1. The ducts 2 communicate through oblique duct portions 4 with a plurality of second outlet openings 5. These second outlet openings 5 form two rows, respectively adjacent each long side of the first outlet opening 3.

The duct portions 4 extend through the burner head 6 which is built into the combustion chamber 11, and which is further bounded by the surfaces 10. In the long side walls of supply duct 1, there are recesses 7 in the form of grooves of square section, which continue into correspondingly shaped recesses or grooves 9 in the burner head 6. The grooves 9 extend into the duct portions 4 at the position of the outlet openings 5. At the position of outlet opening 3 of supply duct 1, the recesses 7 form square recesses 8 in this outlet opening 3 as seen in plan view. As seen in FIG. 1, adjacent each of the second outlet openings 5, there is a recess 8 formed by grooves 7 and 9 in the long side of the outlet opening 3.

Combustion air from the outlets 5 does not blow through the central gas flow, but flows towards it and alongside it.

The grooves 7 widen in the outflow direction towards the outlet opening 3 of the duct 1. This widening is achieved by an increase of the dimension of the groove 7 perpendicular to the long side of the opening 3.

This all leads to a lowering of the point where the turbulence is complete, which produces a very stable flame and a very even and complete combustion of the combustion gas.

What is claimed is

1. A ceramic gas burner for a combustion chamber of a hot-blast stove having parallel vertical supply ducts for the two combustion components, a first one of said ducts having an upwardly opening first outlet opening which has in plan view a substantially rectnagular shape with two long sides and the second of said ducts opening at a plurality of second outlet openings which are located on both sides of and above said first outlet opening, the general discharge directions of the second outlet openings being oblique to that of the first outlet opening, wherein as seen in plan view the first outlet opening has, in its long sides, a plurality of recesses which extend outwardly towards the second outlets said recesses being arranged so that, with respect to each said recess in a first one of said long sides of the first outlet opening, there is correspondingly a said recess directly opposite in the second of said long sides of the first outlet opening.

2. A ceramic gas burner according to claim 1, wherein for each of said second outlet openings in the burner there is correspondingly one of said recesses.

3. A ceramic gas burner according to claim 1 wherein in the outflow direction said recesses have widening cross sections.

4. A ceramic gas burner according to claim 3 wherein the widening of the cross sections of the recesses occurs by increase of the recess width in the direction perpendicular to the respective long side of the first outlet opening.

* * * * *